US012782058B2

(12) United States Patent
Sawada et al.

(10) Patent No.: US 12,782,058 B2
(45) Date of Patent: Nov. 3, 2026

(54) HONEYCOMB STRUCTURE AND HEAT EXCHANGER

(71) Applicant: NGK INSULATORS, LTD., Nagoya-City (JP)

(72) Inventors: Seiya Sawada, Komaki (JP); Takeshi Sakuma, Nagoya (JP); Yutaro Fumoto, Kasugai (JP)

(73) Assignee: NGK INSULATORS, LTD., Nagoya (JP)

( * ) Notice: Subject to any disclaimer, the term of this patent is extended or adjusted under 35 U.S.C. 154(b) by 106 days.

(21) Appl. No.: 18/439,914

(22) Filed: Feb. 13, 2024

(65) Prior Publication Data

US 2024/0310124 A1 Sep. 19, 2024

(30) Foreign Application Priority Data

Mar. 16, 2023 (JP) ..... 2023-042196

(51) Int. Cl.
*F28D 7/10* (2006.01)
*F01N 3/28* (2006.01)
(Continued)

(52) U.S. Cl.
CPC ..... *F28D 7/106* (2013.01); *F01N 3/2828* (2013.01); *F28D 21/0003* (2013.01);
(Continued)

(58) Field of Classification Search
CPC ..... F28D 7/106; F28D 21/0003; F28F 1/16; F28F 1/424; F28F 27/02; F01N 2330/34;
(Continued)

(56) References Cited

U.S. PATENT DOCUMENTS

2002/0117773 A1* 8/2002 Yamada ..... B01J 35/57 425/467
2005/0107244 A1* 5/2005 Ichikawa ..... B01D 46/2455 428/116
(Continued)

FOREIGN PATENT DOCUMENTS

DE 10 2022 200 211 A1 9/2022
JP H09-253504 A 9/1997
(Continued)

OTHER PUBLICATIONS

German Office Action (with English translation) dated Jun. 26, 2025 (Application No. 10 2024 201 525.3).
(Continued)

*Primary Examiner* — Jianying C Atkisson
*Assistant Examiner* — For K Ling
(74) *Attorney, Agent, or Firm* — Muncy, Geissler, Olds & Lowe, P.C.

(57) ABSTRACT

A honeycomb structure includes: an inner peripheral wall; an outer peripheral wall; and partition walls disposed between the inner peripheral wall and the outer peripheral wall, the partition walls defining a plurality of cells each extending from a first end face to a second end face. In a cross section orthogonal to an extending direction of the cells, the partition walls include one or more first partition walls extending in a radial direction. The inner peripheral wall and the outer peripheral wall have an average thickness of 0.1 mm or more, and a thickness variation coefficient of 1.0 or less, represented by the following equation (1):

the thickness variation coefficient=a standard deviation of the thicknesses of the inner peripheral wall and the outer peripheral wall/an average thickness of the inner peripheral wall and the outer peripheral wall (1).

9 Claims, 3 Drawing Sheets

(51) Int. Cl.
*F28D 21/00* (2006.01)
*F28F 1/42* (2006.01)
*F28F 13/00* (2006.01)

(52) U.S. Cl.
CPC ..... *F28F 1/424* (2013.01); *F01N 2330/34* (2013.01); *F28F 13/003* (2013.01)

(58) Field of Classification Search
CPC ..... F01N 3/2828; F01N 2330/06; F01N 2330/30; F01N 2330/48
See application file for complete search history.

(56) References Cited

U.S. PATENT DOCUMENTS

2007/0231533 A1* 10/2007 Aniolek ..... C04B 35/478 428/116
2015/0292812 A1* 10/2015 Tomita ..... F28F 13/12 165/177
2017/0355164 A1* 12/2017 Kato ..... B29D 99/0089
2019/0204031 A1* 7/2019 Kawaguchi ..... F28D 7/163
2019/0277570 A1* 9/2019 Kawaguchi ..... F28F 21/04
2020/0123956 A1* 4/2020 Miyairi ..... F01N 13/009
2020/0254433 A1* 8/2020 Halder ..... B01D 46/2474
2022/0275740 A1 9/2022 Kimura et al.

FOREIGN PATENT DOCUMENTS

JP 2022-132034 A 9/2022
WO 2019/135312 A1 7/2019

OTHER PUBLICATIONS

Japanese Office Action for Japanese Application No. 2023-042196 dated Jun. 30, 2026.

* cited by examiner

HONEYCOMB STRUCTURE AND HEAT EXCHANGER

CROSS REFERENCE TO RELATED APPLICATIONS

The present invention claims the benefit of priority to Japanese Patent Application No 2023-042196 filed on Mar. 16, 2023 with the Japanese Patent Office, the entire contents of which are incorporated herein by reference in its entirety.

FIELD OF THE INVENTION

The present invention relates to a honeycomb structure and a heat exchanger.

BACKGROUND OF THE INVENTION

Recently, there is a need for improvement of fuel economy of motor vehicles. In particular, a system is expected that worms up a coolant, engine oil and an automatic transmission fluid (ATF: Automatic Transmission Fluid) at an early stage to reduce friction losses, in order to prevent deterioration of fuel economy at the time when an engine is cold, such as when the engine is started. Further, a system is expected that heats an exhaust gas purifying catalyst in order to activate the catalyst at an early stage.

As one of the systems as described above, for example, there is a heat exchanger. The heat exchanger is a device that exchanges heat between a first fluid and a second fluid by allowing the first fluid to flow inside and the second fluid to flow outside. In such a heat exchanger, for example, the heat can be effectively utilized by exchanging the heat from the first fluid having a higher temperature (for example, an exhaust gas) to the second fluid having a lower temperature (for example, cooling water).

A heat exchanger that uses a heat exchange member having a honeycomb structure has been proposed as the heat exchanger for recovering heat from high-temperature gases such as exhaust gases from motor vehicles. A heat exchanger member having a hollow honeycomb structure including a hollow region that functions as a bypass route for an exhaust gas has also been proposed.

For example, Patent Literature 1 proposes a heat exchange member including: a hollow honeycomb structure having partition walls defining cells each extending from a first end face to a second end face to form a flow path for a first fluid, an inner peripheral wall, and an outer peripheral wall; and a covering member for covering the outer peripheral wall of the honeycomb structure, wherein in a cross section of the honeycomb structure orthogonal to a flow path direction for the first fluid, the cells are radially provided, and the inner peripheral wall and the outer peripheral wall have thicknesses greater than those of the partition walls, and it also proposes a heat exchanger using the heat exchange member.

A hollow honeycomb structure used in a heat exchanger is subjected to a pressure (which is, hereinafter, referred to as an "internal pressure") due to thermal expansion of a cylindrical member forming a flow path for a first fluid flowing inside the inner peripheral wall. Further, the hollow honeycomb structure is subjected to a pressure (which is, hereinafter, referred to as an "external pressure") due to contraction caused by freezing of a second fluid or pressure variation of the cylindrical member forming a flow path for the second fluid flowing outside the outer peripheral wall. Furthermore, various internal and external pressures as described above may be applied to hollow honeycomb structures used for purposes other than the heat exchangers.

However, the hollow honeycomb structure described in Patent Literature 1 is not sufficiently discussed for a strength against the internal pressure (hereinafter, the strength is referred to as an "internal pressure strength") and a strength against the external pressure (hereinafter, the strength is referred to as an "external pressure strength"), and the structural strength may not be appropriate.

The present invention has been made to solve the problems as described above. An object of the present invention is to provide a honeycomb structure having an improved internal pressure strength and external pressure strength, and a heat exchanger using the same.

PRIOR ART

Patent Literature

[Patent Literature 1] WO 2019/135312 A1

SUMMARY OF THE INVENTION

As a result of intensive studies for honeycomb structures, the present inventors found that an average thickness of the inner peripheral wall and the outer peripheral wall is related to the internal pressure strength, and a thickness variation coefficient of the inter peripheral wall and the outer peripheral wall, represented by a predetermined equation, is related to the external pressure strength. Based on this finding, the present inventors have found that the above problems can be solved by controlling the average thickness of the inner peripheral wall and the outer peripheral wall as well as the thickness variation coefficient represented by the predetermined equation, and they have completed the present invention. That is, the present invention is illustrated as follows:

[1]

A honeycomb structure comprising: an inner peripheral wall; an outer peripheral wall; and partition walls disposed between the inner peripheral wall and the outer peripheral wall, the partition walls defining a plurality of cells each extending from a first end face to a second end face, wherein, in a cross section orthogonal to an extending direction of the cells, the partition walls comprise one or more first partition walls extending in a radial direction, and wherein the inner peripheral wall and the outer peripheral wall have an average thickness of 0.1 mm or more, and a thickness variation coefficient of 1.0 or less, represented by the following equation (1):

$$\text{the thickness variation coefficient} = \text{a standard deviation of the thicknesses of the inner peripheral wall and the outer peripheral wall} / \text{an average thickness of the inner peripheral wall and the outer peripheral wall} \quad (1).$$

[2]

The honeycomb structure according to [1], wherein the partition walls further comprise one or more second partition walls extending in a circumferential direction in a cross section orthogonal to the extending direction of the cells.

[3]

The honeycomb structure according to [1] or [2], wherein the inner peripheral wall has an inner diameter of 20 to 200 mm, and the outer peripheral wall has an outer diameter of 30 to 300 mm.

[4]

The honeycomb structure according to any one of [1] to [3], wherein the number of the first partition walls is 50 to 1500.

[5]

The honeycomb structure according to any one of [2] to [4], wherein the number of the second partition walls is 50 or less.

[6]

The honeycomb structure according to any one of [1] to [5], wherein the first partition walls have an average thickness of 0.1 to 1 mm.

[7]

The honeycomb structure according to any one of [2] to [6], wherein the second partition walls have an average thickness of 0.1 to 1 mm.

[8]

The honeycomb structure according to any one of [1] to [7], wherein a length in the extending direction of the cells is 10 to 300 mm.

[9]

A heat exchanger comprising the honeycomb structure according to any one of [1] to [8].

DETAILED DESCRIPTION OF THE INVENTION

A honeycomb structure acceding to an embodiment of the present invention includes: an inner peripheral wall; an outer peripheral wall; and partition walls disposed between the inner peripheral wall and the outer peripheral wall, the partition walls defining a plurality of cells each extending from a first end face to a second end face. Also, in a cross section orthogonal to an extending direction of the cells, the partition walls include one or more first partition walls extending in a radial direction. Further, the inner peripheral wall and the outer peripheral wall have an average thickness of 0.1 mm or more, and a thickness variation coefficient of 1.0 or less, represented by the following equation (1):

the thickness variation coefficient=a standard deviation of the thicknesses of the inner peripheral wall and the outer peripheral wall/an average thickness of the inner peripheral wall and the outer peripheral wall (1).

By having the above structure, the honeycomb structure according to the embodiment of the present invention can increase both the internal pressure strength and the external pressure strength, and hence has improved structural strength.

A heat exchanger according to an embodiment of the present invention includes the above honeycomb structure.

Since the heat exchanger according to the embodiment of the present invention includes the honeycomb structure having an improved structural strength by increasing both the internal pressure strength and the external pressure strength, reliability can be improved.

Hereinafter, embodiments of the present invention will be specifically described with reference to the drawings. It is to understand that the present invention is not limited to the following embodiments, and those which appropriately added changes, improvements and the like to the following embodiments based on knowledge of a person skilled in the art without departing from the spirit of the present invention fall within the scope of the present invention.

<Honeycomb Structure>

The honeycomb structure according to an embodiment of the present invention can be used for a heat exchanger, a heat storage device, a device used in a DAC (Direct Air Capture) method, and an exhaust gas purification device, and it is particularly suitable for use in a heat exchanger.

Figure 1:
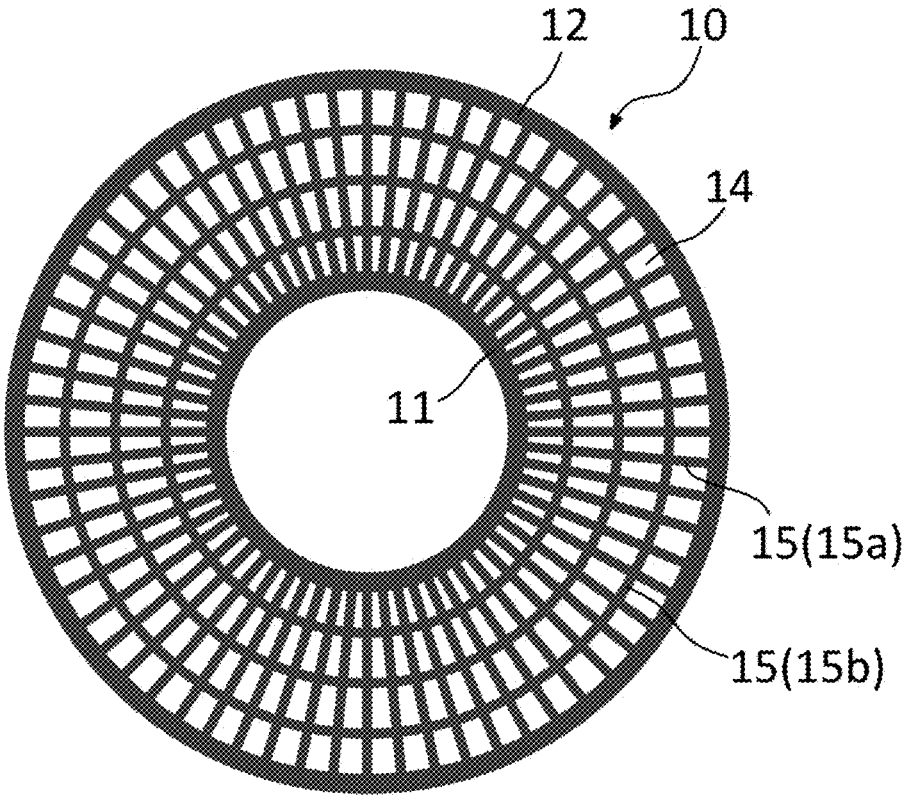
FIG. 1 is a cross-sectional view of a honeycomb structure according to an embodiment of the present invention, which is orthogonal to an extending direction of cells.
Figure 2:
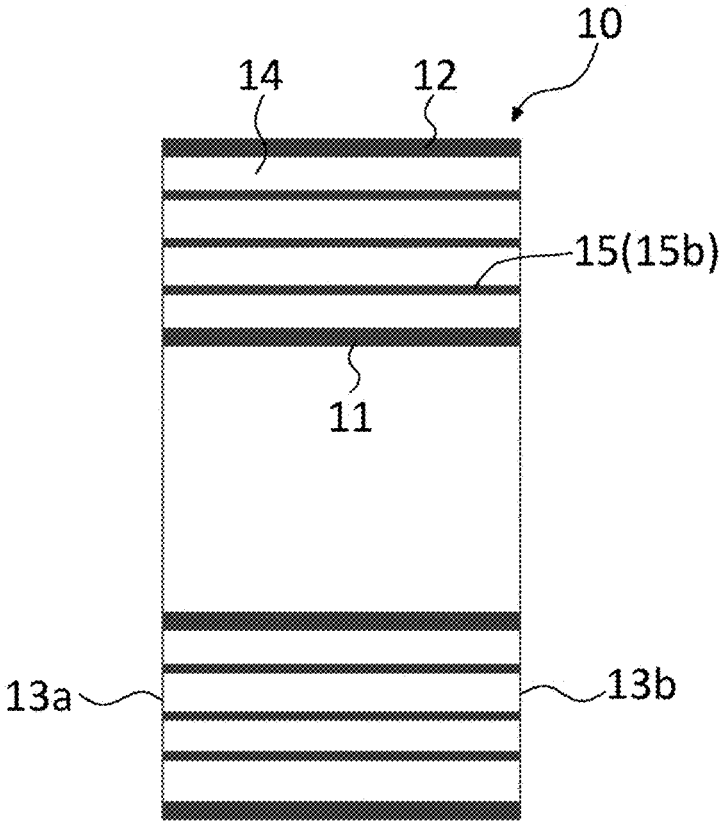
FIG. 2 is a cross-sectional view of a honeycomb structure according to an embodiment of the present invention, which is parallel to an extending direction of cells.

FIG. 1 is a cross-sectional view of a honeycomb structure according to an embodiment of the present invention, which is orthogonal to an extending direction of cells, and FIG. 2 is a cross-sectional view of a honeycomb structure according to an embodiment of the present invention, which is parallel to an extending direction of cells.

As shown in FIGS. 1 and 2, the honeycomb structure 10 includes: an inner peripheral wall 11; an outer peripheral wall 12; and partition walls 15 that are disposed between the inner peripheral wall 11 and the outer peripheral wall 12, and define a plurality of cells 14 each extending from a first end face 13*a* to a second end face 13*b*. In a cross section (FIG. 1) orthogonal to the extending direction of the cells 14 of the honeycomb structure 10, the partition walls 15 include one or more first partition walls 15*a* extending in a radial direction. The partition walls 15 may further include one or more second partition walls 15*b* extending in a circumferential direction in a cross section orthogonal to the extending direction of the cells 14. It should be noted that although FIGS. 1 and 2 show an example in which the partition walls 15 include the second partition walls 15*b*, the second partition walls 15*b* may not be included.

In the honeycomb structure 10 having the above structure, a fluid can flow through the cells 14. The fluid is not particularly limited, and various liquids or gases may be used. For example, when the honeycomb structure 10 is used in a heat exchanger mounted on a motor vehicle, the fluid is preferably an exhaust gas.

Moreover, since the honeycomb structure 10 has one or more first partition walls 15*a* extending in the radial direction, the heat of the fluid can be efficiently transmitted to the outer peripheral wall 12 via the first partition walls 15*a*.

A shape (an outer shape) of the honeycomb structure 10 may be, but not limited to, for example, a circular pillar shape, an elliptic pillar shape, a quadrangular pillar shape or other polygonal pillar shape. Thus, the outer shape of the honeycomb structure 10 (i.e., the outer shape of the outer peripheral wall 12) in the cross section in FIG. 1 may be circular, elliptical, quadrangular or other polygonal.

Also, a shape of a hollow region in the honeycomb structure 10 may be, but not limited to, for example, a circular pillar shape, an elliptic pillar shape, a quadrangular pillar shape or other polygonal pillar shape. Thus, the shape of the hollow region (i.e., the inner shape of the inner peripheral wall 11) in the cross section in FIG. 1 may be circular, elliptical, quadrangular or other polygonal.

Although the shapes of the honeycomb structure 10 and the hollow region may be the same as or different from each other, it is preferable that they are the same as each other, in terms of ensuring the internal pressure strength and the external pressure strength.

The inner peripheral wall 11 has an average thickness of 0.1 mm or more, and a thickness variation coefficient of 1.0 or less, which is represented by the following equation (1a):

$$\text{The thickness variation coefficient} = \text{a standard deviation of the thickness of the inner peripheral wall 11/an average thickness of the inner peripheral wall 11} \quad (1a)$$

By controlling the average thickness of the inner peripheral wall 11 to the above range, the strength against the internal pressure (that is, the internal pressure strength) can be ensured. Further, by controlling the thickness variation coefficient of the inner peripheral wall 11 to the above range, the strength against the external pressure (that is, the external pressure strength) can be ensured.

As used herein, the average thickness of the inner peripheral wall 11 is an average value of the thickness of the inner peripheral wall 11 in a cross section orthogonal to the extending direction of the cells 14. The average thickness of the inner peripheral wall 11 can be determined by measuring the thickness of the inner peripheral wall 11 in at least eight arbitrary positions and calculating an average value thereof.

If the average thickness of the inner peripheral wall 11 is less than 0.1 mm, a portion with an insufficient internal pressure strength will be present in the inner peripheral wall 11, so that the honeycomb structure 10 will be easily destroyed starting from that portion. In particular, the entire inner peripheral wall 11 cannot withstand the internal pressure, so that the inner peripheral wall 11 tends to be broken due to the force of expanding the inner peripheral wall 11 in the circumferential direction. The average thickness of the inner peripheral wall 11 is preferably 0.1 to 10 mm, and more preferably 0.5 to 3 mm, from the viewpoint of stably ensuring the internal pressure strength of the inner peripheral wall 11.

The standard deviation of the thickness of the inner peripheral wall 11 used for calculating the thickness variation coefficient is an index representing a degree of a variation in the thickness of the inner peripheral wall 11 from the average thickness. The variation in the thickness of the inner peripheral wall 11 affects the external pressure strength. However, even if the standard deviation of the thickness of the inner peripheral wall 11 is the same, different average thicknesses of the inner peripheral wall 11 will change the external pressure strength. Therefore, the value obtained by dividing the standard deviation of the thickness of the inner peripheral wall 11 by the average thickness of the inner peripheral wall 11 is defined as the thickness variation coefficient, and the thickness variation coefficient is used as an index for ensuring the external pressure strength.

Here, the standard deviation of the thickness of the inner peripheral wall 11 is determined by measuring the thickness of the inner peripheral wall 11 in at least eight arbitrary positions in the same manner as the average thickness of the inner peripheral wall 11, and then calculating the standard deviation from the measurement data by a well-known method.

If the thickness variation coefficient of the inner peripheral wall 11 is more than 1.0, the standard deviation (degree of variation) of the thickness of the inner peripheral wall 11 is larger, so that a portion with an insufficient external pressure strength will be present in the inner peripheral wall 11 and the honeycomb structure 10 tends to be destroyed starting from that portion. The thickness variation coefficient of the inner peripheral wall 11 is preferably 0.6 or less from the viewpoint of stably ensuring the external pressure strength of the inner peripheral wall 11.

The inner diameter of the inner peripheral wall 11 (the diameter on the inner side of the inner peripheral wall 11 in the cross section orthogonal to the extending direction of the cells 14) is not particularly limited, but it may preferably be 20 to 200 mm, and more preferably more than 50 mm and 75 mm or less. By controlling the inner diameter of the inner peripheral wall 11 to such a range, the suppression of pressure loss and compactness can be achieved at the same time.

It should be noted that when the cross-sectional shape of the inner peripheral wall 11 is not circular, the diameter of the largest inscribed circle inscribed in the cross-sectional shape of the inner peripheral wall 11 is defined as the inner diameter of the inner peripheral wall 11.

The outer peripheral wall 12 has an average thickness of 0.1 mm or more, and a thickness variation coefficient of 1.0 or less, represented by the following equation (1b):

$$\text{The thickness variation coefficient} = \text{a standard deviation of the thickness of the outer peripheral wall 12/an average thickness of the outer peripheral wall 12} \quad (1b)$$

By controlling the average thickness of the outer peripheral wall 12 to the above range, the strength against the internal pressure (that is, the internal pressure strength) can be ensured. Furthermore, by controlling the thickness variation coefficient of the outer peripheral wall 12 to the above range, the strength against the external pressure (that is, the external pressure strength) can be ensured.

Here, the average thickness of the outer peripheral wall 12 is an average value of the thickness of the outer peripheral wall 12 in the cross section orthogonal to the extending direction of the cells 14. The average thickness of the outer peripheral wall 12 can be determined by measuring the thickness of the outer peripheral wall 12 in at least eight arbitrary positions and calculating an average value thereof.

If the average thickness of the outer peripheral wall 12 is less than 0.1 mm, a portion with an insufficient internal pressure strength will be present in the outer peripheral wall 12, so that the honeycomb structure 10 will tend to be destroyed starting from that portion. The average thickness of the outer peripheral wall 12 is preferably 0.1 to 10 mm, and more preferably 0.5 to 3 mm, from the viewpoint of stably ensuring the internal pressure strength of the outer peripheral wall 12.

The standard deviation of the thickness of the outer peripheral wall 12 used for calculating the thickness variation coefficient is an index representing a degree of a variation in the thickness of the outer peripheral wall 12 from the average thickness. The variation in the thickness of the outer peripheral wall 12 affect the external pressure strength. However, even if the standard deviation of the thickness of the outer peripheral wall 12 is the same, different average thicknesses of the outer peripheral wall 12 will change the external pressure strength. Therefore, the value obtained by dividing the standard deviation of the thickness of the outer peripheral wall 12 by the average thickness of the outer peripheral wall 12 is defined as the thickness variation coefficient, and the thickness variation coefficient is used as an index for ensuring the external pressure strength by the outer peripheral wall 12.

Here, the standard deviation of the thickness of the outer peripheral wall 12 can be calculated from measurement data from a well-known method after measuring the thickness of the outer peripheral wall 12 in at least eight arbitrary positions in the same manner as the average thickness of the outer peripheral wall 12.

When the thickness variation coefficient of the outer peripheral wall 12 is more than 1.0, the standard deviation (degree of variation) of the thickness of the outer peripheral wall 12 is larger, so that the thinner portion of the outer peripheral wall 12 tends to be broken. The thickness variation coefficient of the outer peripheral wall 12 is preferably 0.6 or less, from the viewpoint of stably ensuring the external pressure strength of the outer peripheral wall 12.

An outer diameter of the outer peripheral wall 12 (a diameter on an outer side of the outer peripheral wall 12 in the cross section orthogonal to the extending direction of the cells 14) may preferably be from 30 to 300 mm, and more preferably from 60 to 100 mm, although not particularly limited thereto. By controlling the outer diameter of the outer peripheral wall 12 to such a range, both the suppression of the pressure loss and compactness can be achieved at the same time.

When the shape of the outer peripheral wall 12 is not circular, the diameter of the largest inscribed circle inscribed in the cross-sectional shape of the outer peripheral wall 12 is defined as the outer diameter of the outer peripheral wall 12.

The number of the first partition walls 15*a* may preferably be 50 to 1,500, and more preferably 100 to 1,000, although not particularly limited thereto. By controlling the number of the first partition walls 15*a* to such a range, it becomes easier to ensure the internal pressure strength and the external pressure strength while achieving both improvement of heat recovery efficiency and suppression of an increase in pressure loss.

Here, the number of the first partition walls 15*a* is calculated by considering the partition walls 15 extending in the radial direction from the inner peripheral wall 11 to the outer peripheral wall 12 as one first partition wall 15*a* in a cross section orthogonal to the extending direction of the cells 14.

The average thickness of the first partition walls 15*a* may preferably be 0.1 to 1 mm, and more preferably 0.2 to 0.6 mm, although not particularly limited thereto. By controlling the average thickness of the first partition walls 15*a* to such a range, it becomes easier to ensure the internal pressure strength and the external pressure strength.

Here, the average thickness of the first partition walls 15*a* is an average value of the thicknesses of the first partition walls 15*a* in the cross section orthogonal to the extending direction of the cells 14. The average thickness of the first partition walls 15*a* can be obtained by measuring the thicknesses of the first partition walls 15*a* in at least eight arbitrary positions and calculating an average value thereof.

The number of the second partition walls 15*b* may preferably be 50 or less, and more preferably 1 to 25, although not particularly limited thereto. By controlling the number of the second partition walls 15*b* to such a range, it becomes easier to ensure the internal pressure strength and the external pressure strength while achieving both improvement of heat recovery efficiency and suppression of an increase in pressure loss.

Here, the number of the second partition walls 15*b* is calculated by considering the annular partition walls 15 extending in the circumferential direction as one second partition wall 15*b* in the cross section orthogonal to the extending direction of the cells 14.

The average thickness of the second partition walls 15*b* may preferably be 0.1 to 1 mm, and more preferably 0.2 to 0.6 mm, although not particularly limited thereto. By controlling the average thickness of the second partition walls 15*b* to such a range, it becomes easier to ensure the internal pressure strength and the external pressure strength.

Here, the average thickness of the second partition walls 15*b* is an average value of the thicknesses of the second partition walls 15*b* in the cross section orthogonal to the extending direction of the cells 14. The average thickness of the second partition walls 15*b* can be obtained by measuring the thicknesses of the second partition walls 15*b* in at least eight arbitrary positions and calculating an average value thereof.

In the honeycomb structure according to the embodiment of the present invention, the length in the extending direction of the cells 14 is preferably 10 to 300 mm, and more preferably 20 to 200 mm. By controlling the length in the extending direction of the cells 14 to such a range, it becomes easier to ensure the internal pressure strength and the external pressure strength.

Here, the length in the extending direction of the cells 14 is a length from the first end face 13*a* to the second end face 13*b* in the cross section parallel to the extending direction of the cells 14.

The inner peripheral wall 11, the outer peripheral wall 12 and the partition walls 18 preferably contain ceramics as a main component. The phrase "contain ceramics as a main component" means that a ratio of a mass of ceramics to a mass of the total component is 50% by mass or more.

Each of the inner peripheral wall 11, the outer peripheral wall 12 and the partition walls 15 preferably has a porosity of 10% or less, and more preferably 5% or less, and even more preferably 3% or less. Further, the porosity of the inner peripheral wall 11, the outer peripheral wall 12 and the partition walls 15 may be 0%. The porosity of the inner peripheral wall 11, the outer peripheral wall 12 and the partition walls 15 of 10% or less can lead to improvement of thermal conductivity.

The inner peripheral wall 11, the outer peripheral wall 12 and partition walls 15 preferably contain SiC (silicon carbide) having high thermal conductivity as a main component. The phrase "contain SiC (silicon carbide) as a main component" means that a mass ratio of SiC (silicon carbide) to the total component is 50% by mass or more.

Specific examples of materials for the inner peripheral wall 11, the outer peripheral wall 12 and partition walls 15 include Si-impregnated SiC, (Si+Al) impregnated SiC, a metal composite SiC, recrystallized SiC, $Si_3N_4$, SiC, and the like. Among them, Si-impregnated SiC and (Si+Al) impregnated SiC are preferably used because they can allow production at lower cost and have high thermal conductivity.

The honeycomb structure 10 preferably has a thermal conductivity of 50 W/(m·K) or more at 25° C., and more preferably from 100 to 300 W/(m·K), and even more preferably from 120 to 300 W/(m K). The thermal conductivity of the honeycomb structure 10 in such a range can lead to an improved thermal conductivity and can allow the heat inside the honeycomb structure 10 to be efficiently transmitted to the outside. It should be noted that the value of thermal conductivity is a value measured according to the laser flash method (JIS R 1611:1997).

In the case where an exhaust gas as the first fluid flows through the cells 14 in the honeycomb structure 10, a catalyst may preferably be supported on the partition walls 15 of the honeycomb structure 10. The supporting of the catalyst on the partition walls 15 can allow CO, NOx, HC and the like in the exhaust gas to be converted into harmless substances through catalytic reaction, and can also allow reaction heat generated during the catalytic reaction to be utilized for heat exchange. Preferable catalysts include those containing at least one element selected from the group consisting of noble metals (platinum, rhodium, palladium, ruthenium, indium, silver and gold), aluminum, nickel, zirconium, titanium, cerium, cobalt, manganese, zinc, copper, tin, iron, niobium, magnesium, lanthanum, samarium, bismuth, and barium. Any of the above-listed elements may be contained as a metal simple substance, a metal oxide, or other metal compound.

A supported amount of the catalyst (catalyst metal+support) may preferably be from 10 to 400 g/L. Further, when using the catalyst containing the noble metal(s), the supported amount may preferably be from 0.1 to 5 g/L. The supported amount of the catalyst (catalyst metal+support) of 10 g/L or more can easily achieve catalysis. On the other hand, the supported amount of 400 g/L or less can suppress increases in manufacturing cost and pressure loss. The support refers to a carrier on which the catalyst metal is supported. Examples of the supports include those containing at least one selected from the group consisting of alumina, ceria and zirconia.

The honeycomb structure 10 according to the embodiment of the present invention can be produced according to known methods. First, a green body containing ceramic powder is extruded into a desired shape to prepare a honeycomb formed body. At this time, the average thickness and the inner diameter of the inner peripheral wall 11, the average thickness and the outer diameter of the outer peripheral wall 12, the average thickness and the number of the partition walls 15 (the first partition walls 15*a* and the second partition walls 15*b*), and the like, can be controlled by selecting dies and jig in appropriate forms. For example, when producing a honeycomb formed body based on a Si-impregnated SiC composite, a binder and water or an organic solvent are added to a predetermined amount of SiC powder, and the resulting mixture is kneaded to form a green body, which is formed into a honeycomb formed body having a desired shape. The resulting honeycomb formed body can be then dried, and the honeycomb formed body can be impregnated with metal Si and fired under reduced pressure in an inert gas or vacuum to obtain the honeycomb structure 10. Also, the standard deviation of the thickness of the inner peripheral wall 11 and the outer peripheral wall 12 can be controlled by grinding the inner peripheral wall 11 and the outer peripheral wall 12 of the dried honeycomb formed body before firing. The method of grinding is not particularly limited, and known methods such as cylindrical grinding and centerless grinding can be used.

<Heat Exchanger>

Figure 3:
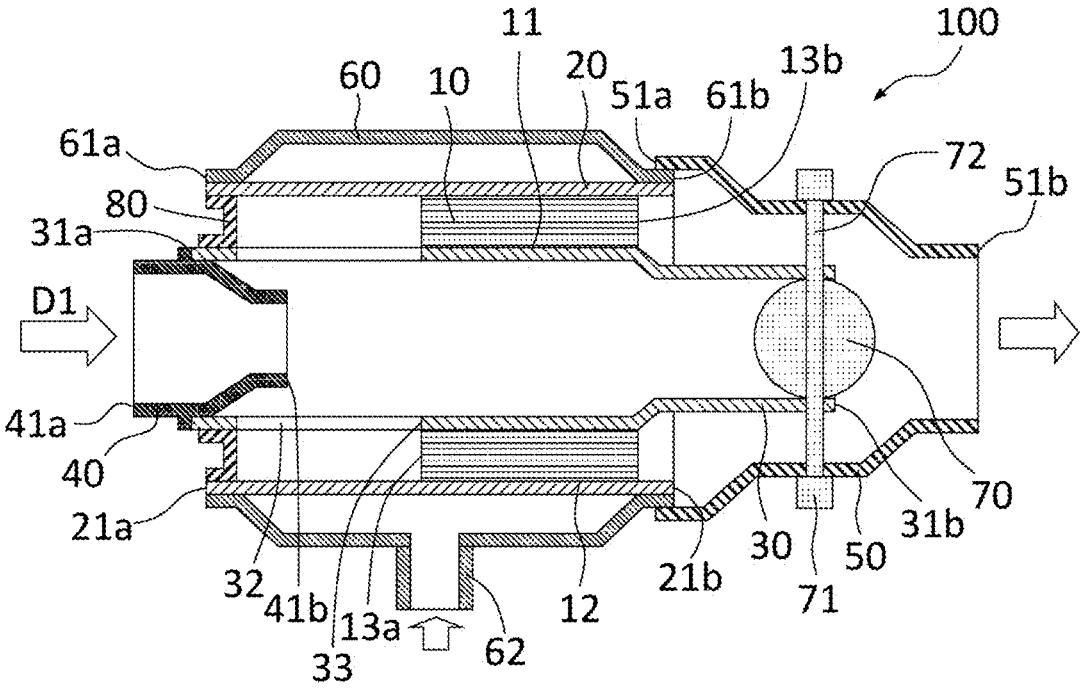
FIG. 3 is a cross-sectional view of a heat exchanger according to an embodiment of the present invention, which is parallel to an extending direction of cells

FIG. 3 is a cross-sectional view of a heat exchanger according to an embodiment of the present invention which is parallel to the extending direction of the cells.

As shown in FIG. 3, a heat exchanger 100 according to an embodiment of the present invention includes: the honeycomb structure 10; a first outer cylindrical member 20; a first inner cylindrical member 30; a second inner cylindrical member 40; a tubular member 50; a second outer cylindrical member 60; an on-off valve 70; and a ring-shaped member 80. In this heat exchanger 100, the first fluid flows through a region on an inner side than the first outer cylindrical member 20 (for example, the cells of the honeycomb structure 10, and the like), and the second fluid flows through a region on an outer side than the first outer cylindrical member 20 (between the first outer cylindrical member 20 and the second outer cylindrical member 60).

In the heat exchanger 100, the end portion of the first inner cylindrical member 30 on the side of an inflow port 31*a* is joined to the first outer cylindrical member 20 and/or the second inner cylindrical member 40, so that at least one through hole 32 for introducing the first fluid is provided on the upstream side of the first end face 13*a* of the honeycomb structure 10. Also, an outflow port 41*b* of the second inner cylindrical member 40 is positioned on a radially inner side of the first inner cylindrical member 30, and on the upstream side of a downstream end portion 33 of the through hole 32 of the first inner cylindrical member 30 based on a flow direction D1 of the first fluid as a reference.

The structure as described above can prevent the flow of the first fluid (exhaust gas) that has flowed out through the outflow port 41*b* of the second inner cylindrical member 40 from being turned back during the heat recovery mode. Therefore, during the heat recovery mode, an increase in pressure loss (flow path resistance) can be sufficiently suppressed, so that damage or bursting of the heat exchanger 100 is difficult to occur. Moreover, the length of the second inner cylindrical member 40 can be shortened, so that the weight of the heat exchanger 100 and the production cost can be reduced. Further, the diameter of the outflow port 41*b* of the second inner cylindrical member 40 is smaller than that of the first inner cylindrical member 30, so that the first fluid that has flowed out through the outflow port 41*b* of the second inner cylindrical member 40 is difficult to pass through the through hole 32 during the non-heat recovery mode and tends to flow smoothly through the first inner cylindrical member 30. Therefore, the heat will be difficult to be transferred to the honeycomb structure 10, so that the heat shielding performance can be improved.

In the heat exchanger 100, based on the flow direction D1 of the first fluid as a reference, the central portion of the axial length of the honeycomb structure 10 is positioned on the downstream side of the central portion of the first outer cylindrical member 20 and the second outer cylindrical member 60. The first end face 13*a* of the honeycomb structure 10 is aligned at the same position as the downstream end portion 33 of the through hole 32 provided in the first inner cylindrical member 30, and the upstream end portion of the through hole 32 is aligned at the same position as a position of a downstream end portion of the ring-shaped member 80. Therefore, the through hole 32 can be provided so as to be long in the axial direction of the first inner cylindrical member 30, so that the effect of suppressing the increase in pressure loss (flow path resistance) during the heat recovery mode can be enhanced. Further, the contact area of the first outer cylindrical member 20 with the first fluid at elevated temperature can be increased, so that the heat transfer to the second fluid can be increased to improve the heat exchange efficiency.

In the heat exchanger 100, based on the flow direction D1 of the first fluid as a reference, the position of the downstream end portion of the flow path for the second fluid formed between the first outer cylindrical member 20 and the second outer cylindrical member 60 and the position of the second end face 13*b* of the honeycomb structure 10 are aligned with each other, so that the heat exchange performance during the heat recovery mode is sufficiently ensured.

Further, in the heat exchanger 100, a feed pipe 62 and a discharge pipe (not shown) are arranged in the circumferential direction orthogonal to the axial direction of the second outer cylindrical member 60. By thus providing the feed pipe 62 and the discharge pipe, parts such as an actuator for the on-off valve 70 are easily installed on the surface of the second outer cylindrical member 60 between the feed pipe 62 and the discharge pipe while sufficiently ensuring the heat exchange performance during the heat recovery mode, so that the heat exchanger 200 can be made compact.

The first outer cylindrical member 20 is a cylindrical member that has an inflow port 21*a* and an outflow port 21*b* for the first fluid and is fitted to an outer peripheral wall 12 surface of the honeycomb structure 10.

As used herein, the "fitted" means that members are fixed in a state of being suited to each other. Therefore, the fitting of the honeycomb structure 10 and the first outer cylindrical member 20 encompasses cases where the honeycomb structure 10 and the first outer cylindrical member 20 are fixed to each other by a fixing method based on fitting such as clearance fitting, interference fitting and shrinkage fitting, as well as by brazing, welding, diffusion bonding, and the like.

It is preferable that the axial direction of the first outer cylindrical member 20 coincides with the axial direction of the honeycomb structure 10, and the central axis of the first outer cylindrical member 20 coincides with the central axis of the honeycomb structure 10.

Also, the diameter (outer diameter and inner diameter) of the first outer cylindrical member 20 may be uniform in the axial direction, but the diameter of at least a portion (for example, at least one end side in the axial direction or the like) may be decreased or increased.

The first outer cylindrical member 20 may preferably have an inner surface shape corresponding to the outer peripheral wall 12 surface of the honeycomb structure 10. Since the inner surface of the first outer cylindrical member 20 is in direct contact with the outer peripheral wall 12 surface of the honeycomb structure 10, the thermal conductivity is improved and the heat in the honeycomb structure 10 can be efficiently transferred to the first outer cylindrical member 20.

In terms of improvement of the heat recovery efficiency, a higher ratio of an area of a portion of the outer peripheral wall 12 surface of the honeycomb structure 10, which is circumferentially covered with the first outer cylindrical member 20, to the total area of the outer peripheral wall 12 surface of the honeycomb structure 10 is preferable. Specifically, the area ratio is preferably 80% or more, and more preferably 90% or more, and even more preferably 100% (that is, the entire outer peripheral wall 12 surface of the honeycomb structure 10 is circumferentially covered with the first outer cylindrical member 20).

It should be noted that the term "the outer peripheral wall 12 surface" as used herein refers to a surface of the honeycomb structure 10, which is parallel to the flow path direction of the first fluid, and does not include surfaces (the first end face 13*a* and the second end face 13*b*) of the honeycomb structure 10, which are perpendicular to the flow path direction of the first fluid.

The first outer cylindrical member 20 is preferably made of a metal in terms of manufacturability, although not particularly limited thereto. Further, the metallic first outer cylindrical member 20 is also preferable in that it can be easily welded to other members such as a second inner cylindrical member 70. Examples of the material of the first outer cylindrical member 20 that can be used herein include stainless steel, titanium alloys, copper alloys, aluminum alloys, brass and the like. Among them, the stainless steel is preferable because it has high durability and reliability and is inexpensive.

The first outer cylindrical member 20 preferably has a thickness of 0.1 mm or more, and more preferably 0.3 mm or more, and still more preferably 0.5 mm or more, although not particularly limited thereto. The thickness of the first outer cylindrical member 20 of 0.1 mm or more can ensure durability and reliability. The thickness of the first outer cylindrical member 20 is preferably 10 mm or less, and more preferably 5 mm or less, and still more preferably 3 mm or less. The thickness of the first outer cylindrical member 20 of 10 mm or less can reduce thermal resistance and improve thermal conductivity.

The first inner cylindrical member 30 is a cylindrical member that has an inflow port 31*a* and an outflow port 31*b* for the first fluid and is fitted to the inner peripheral wall 11 surface of the honeycomb structure 10. Here, the first inner cylindrical member 30 may be directly fitted to the inner peripheral wall 11 surface of the honeycomb structure 10, or may be fitted indirectly via another member such as a seal member.

The axial direction of the first inner cylindrical member 30 preferably coincides with that of the honeycomb structure 10, and the central axis of the first inner cylindrical member 30 preferably coincides with that of the honeycomb structure 10. Also, the diameter (outer diameter and inner diameter) of the first inner cylindrical member 30 may be uniform in the axial direction, but the diameter of at least a portion (e.g., the outflow port 31*b* side) may be decreased or increased.

The shape of the through hole 32 provided in the first inner cylindrical member 30 is not particularly limited, and various shapes such as circular, elliptical, and quadrangular shapes can be used. Also, the number of through holes 32 is not particularly limited, and a plurality of through holes 32 may be provided in the circumferential direction of the first inner cylindrical member 30 or may be provided in the axial direction of the first inner cylindrical member 30. When the plurality of through holes 32 are provided, the above "downstream end portion 33 of the through hole 32 of the first inner cylindrical member 30" means the downstream end portion 33 of the through hole 32 located on the most downstream side of the first inner cylindrical member 30.

The first inner cylindrical member 30 is preferably made of a metal in terms of manufacturability, although not particularly limited thereto. Examples of the material of the first inner cylindrical member 30 that can be used herein include stainless steel, titanium alloys, copper alloys, aluminum alloys, brass and the like. Among them, the stainless steel is preferable because it has high durability and reliability and is inexpensive.

The first inner cylindrical member 30 preferably has a thickness of 0.1 mm or more, and more preferably 0.3 mm or more, and still more preferably 0.5 mm or more, although not particularly limited thereto. The thickness of the first inner cylindrical member 30 of 0.1 mm or more can ensure durability and reliability. The thickness of the first inner cylindrical member 30 is preferably 10 mm or less, and more preferably 5 mm or less, and still more preferably 3 mm or less. The thickness of the first inner cylindrical member 30 of 10 mm or less can reduce the weight of the heat exchanger 100.

The second inner cylindrical member 40 is a cylindrical member that has an inflow port 41*a* and an outflow port 41*b* for the first fluid.

The axial direction of the second inner cylindrical member 40 preferably coincides with that of the honeycomb structure 10, and the central axis of the second inner cylindrical member 40 preferably coincides with that of the honeycomb structure 10. Also, the diameter (outer diameter and inner diameter) of the second inner cylindrical member 40 may be uniform in the axial direction, but the diameter of at least a portion (e.g., the outflow port 41*b* side or the like) may be decreased or increased.

The inner diameter of the outflow port 41*b* of the second inner cylindrical member 40 is smaller than that of the inflow port 31*a* of the first inner cylindrical member 30. By thus controlling the inner diameter of the outflow port 41*b* of the second inner cylindrical member 40, the first fluid flowing out through the outflow port 41*b* of the second inner cylindrical member 40 tends to flow smoothly into the first inner cylindrical member 30 during the non-heat recovery mode. Therefore, heat is difficult to be transferred to the honeycomb structure 10, so that the heat shielding performance can be improved.

The second inner cylindrical member 40 preferably has a streamlined structure having a diameter gradually decreasing toward the outflow port 41*b*. Such a structure can enhance the effect that the first fluid flowing out thought the outflow port 41*b* of the second inner cylindrical member 40 tends to flow smoothly into the first inner cylindrical member 30 during the non-heat recovery mode. Moreover, the pressure loss when the fluid passes through the second inner cylindrical member 40 can be reduced.

Although the shape of the outflow port 41*b* of the second inner cylindrical member 40 is not particularly limited, it is preferably polygonal or elliptical. Such a structure can stably enhance the effect that the first fluid flowing out through the outflow port 41*b* of the second inner cylindrical member 40 tends to flow smoothly into the first inner cylindrical member 30 during the non-heat recovery mode.

A method of fixing the second inner cylindrical member 40 is not particularly limited, but the second inner cylindrical member 40 may be fixed to the first cylindrical member 20, or the second inner cylindrical member 40 may be fixed to a ring-shaped member 80. The fixing method includes, but not limited to, a fixing method by fitting such as clearance fitting, interference fitting and shrinkage fitting, as well as by brazing, welding, diffusion bonding, and the like.

The second inner cylindrical member 40 is preferably made of a metal in terms of manufacturability, although not particularly limited thereto. Examples of the material of the second inner cylindrical member 40 that can be used herein include stainless steel, titanium alloys, copper alloys, aluminum alloys, brass and the like. Among them, the stainless steel is preferable because it has high durability and reliability and is inexpensive.

The second inner cylindrical member 40 preferably has a thickness of 0.1 mm or more, and more preferably 0.3 mm or more, and still more preferably 0.5 mm or more, although not particularly limited thereto. The thickness of the second inner cylindrical member 40 of 0.1 mm or more can ensure durability and reliability. The thickness of the second inner cylindrical member 40 is preferably 10 mm or less, and more preferably 5 mm or less, and still more preferably 3 mm or less. The thickness of the second inner cylindrical member 40 of 10 mm or less can reduce the weight of the heat exchanger 100.

The tubular member 50 is a member connected to the outflow port 21*b* side of the first outer cylindrical member 20. Further, the tubular member 50 has a portion arranged at a space so as to form the flow path for the first fluid on the radially outer side of the first inner cylindrical member 30.

The connection of the tubular member 50 to the first outer cylindrical member 20 may be either direct or indirect. In the case of indirect connection, for example, the second outer cylindrical member 60 or the like may be arranged between the first outer cylindrical member 20 and the tubular member 50.

The tubular member 50 has an inflow port 51*a* and an outflow port 51*b*.

The axial direction of the tubular member 50 preferably coincides with that of the honeycomb structure 10, and the central axis of the tubular member 50 preferably coincides with that of the honeycomb structure 10. Further, the diameter (outer diameter and inner diameter) of the tubular member 50 may be uniform over the axial direction, but the diameter of at least a portion may be decreased or increased.

The tubular member 30 is preferably made of a metal in terms of manufacturability, although not particularly limited thereto. Examples of the material of the tubular member 20 that can be used herein include stainless steel, titanium alloys, copper alloys, aluminum alloys, brass and the like. Among them, the stainless steel is preferable because it has high durability and reliability and is inexpensive.

The tubular member 50 preferably has a thickness of 0.1 mm or more, and more preferably 0.3 mm or more, and still more preferably 0.5 mm or more, although not particularly limited thereto. The thickness of the tubular member 50 of 0.1 mm or more can ensure durability and reliability. The thickness of the tubular member 50 is preferably 10 mm or less, and more preferably 5 mm or less, and still more preferably 3 mm or less. The thickness of the tubular member 50 of 10 mm or less can reduce the weight of the heat exchanger 100.

The second outer cylindrical member 60 is a cylindrical member arranged at a space on a radially outer side of the first outer cylindrical member 20. A second fluid can flow between the second outer cylindrical member 60 and the first outer cylindrical member 20.

The second outer cylindrical member 60 has an inflow port 61*a* and an outflow port 61*b*.

The axial direction of the second outer cylindrical member 60 preferably coincides with that of the honeycomb structure 10 and the central axis of the second outer cylindrical member 60 preferably coincides with that of the honeycomb structure 10.

The second outer cylindrical member 60 is preferably connected to both a feed pipe 62 for feeding the second fluid to a region between the second outer cylindrical member 60 and the first outer cylindrical member 20, and a discharge pipe for discharging the second fluid from a region between the second outer cylindrical member 60 and the first outer cylindrical member 20. The feed pipe 62 and the discharge pipe are preferably provided at positions corresponding to both axial end portions of the honeycomb structure 10, respectively.

The feed pipe 62 and the discharge pipe may extend in the same direction, or may extend in different directions.

The second outer cylindrical member 60 is preferably arranged such that inner peripheral surfaces of both end portions in the axial direction are in direct or indirect contact with the outer peripheral surface of the first outer cylindrical member 20.

A method of fixing the inner peripheral surfaces of both end portions in the axial direction to the outer peripheral surface of the first outer cylindrical member 20 that can be used herein includes, but not limited to, a fixing method by fitting such as clearance fitting, interference fitting and shrinkage fitting, as well as by brazing, welding, diffusion bonding, and the like.

The diameter (outer diameter and inner diameter) of the second outer cylindrical member 60 may be uniform in the axial direction, but the diameter of at least a portion (for example, a central portion in the axial direction, both ends in the axial direction, or the like) of the second outer cylindrical member 60 may be decreased or increased. For example, by decreasing the diameter of the central portion in the axial direction of the second outer cylindrical member 60, the second fluid can spread throughout the outer peripheral direction of the first outer cylindrical member 20 in the second outer cylindrical member 60 on the feed pipe 62 and discharge pipe sides. Therefore, an amount of the second fluid that does not contribute to the heat exchange at the central portion in the axial direction is reduced, so that the heat exchange efficiency can be improved.

The second outer cylindrical member 60 is preferably made of a metal in terms of manufacturability, although not particularly limited thereto. Examples of the material of the second outer cylindrical member 60 that can be used herein include stainless steel, titanium alloys, copper alloys, aluminum alloys, brass and the like. Among them, the stainless steel is preferable because it has high durability and reliability and is inexpensive.

The second outer cylindrical member 60 preferably has a thickness of 0.1 mm or more, and more preferably 0.3 mm or more, and still more preferably 0.5 mm or more, although not particularly limited thereto. The thickness of the second outer cylindrical member 60 of 0.1 mm or more can ensure durability and reliability. The thickness of the second outer cylindrical member 60 is preferably 10 mm or less, and more preferably 5 mm or less, and still more preferably 3 mm or less. The thickness of the second outer cylindrical member 60 of 10 mm or less can reduce the weight of the heat exchanger 100.

The on-off valve 70 is arranged on the outflow port 31*b* side of the inner cylindrical member 30.

The on-off valve 70 is rotatably supported by a bearing 71 arranged on a radially outer side of the tubular member 50, and is fixed to a shaft 72 arranged so as to penetrate the tubular member 50 and the inner cylindrical member 30.

The shape of the on-off valve 70 is not particularly limited, but it may be appropriately selected depending on the shape of the inner cylindrical member 30 in which the on-off valve 70 is to be arranged.

The on-off valve 70 can drive (rotate) the shaft 72 by an actuator (not shown). The on-off valve 70 can be opened and closed by rotating the on-off valve 70 together with the shaft 72.

The on-off valve 70 is configured so that the flow of the first fluid inside the inner cylindrical member 30 can be controlled. More particularly, by closing the on-off valve 70 during the heat recovery mode, the first fluid can be circulated through the honeycomb structure 10. Further, by opening the on-off valve 70 during the non-heat recovery mode, the first fluid can be circulated from the outflow port 31*b* side of the inner cylindrical member 30 to the tubular member 50 to discharge the first fluid to the outside of the heat exchanger 100.

The ring-shaped member 80 is a cylindrical member for connecting the inflow port 21*a* side of the first outer cylindrical member 20 to the second inner cylindrical member 40 so as to form the flow path for the first fluid. The connection position of the second inner cylindrical member 40 to which the ring-shaped member 80 is connected is not particularly limited, and it may be on the inflow port 41*a* side, on the outflow port 41*b* side, or near the central portion of the second inner cylindrical member 40, but it may preferably be such that the distance between the inflow port 41*a* of the second inner cylindrical member 40 and the inflow port 21*a* of the first outer cylindrical member 20 in the flow direction D1 of the first fluid is preferably 20 mm or less, and more preferably 1 to 15 mm, and more preferably 5 to 10 mm. The reason is as described above.

The connection of the first outer cylindrical member 20 to the second inner cylindrical member 40 by the ring-shaped member 80 may be either direct or indirect. In the case of indirect connection, for example, the second outer cylindrical member 60 or the like may be arranged between the first outer cylindrical member 20 and the ring-shaped member 80.

The axial direction of the ring-shaped member 80 preferably coincides with that of the honeycomb structure 10, and the central axis of the ring-shaped member 80 preferably coincides with that of the honeycomb structure 10.

Although the shape of the ring-shaped member 80 is not particularly limited, it may have a curved surface structure. Such a structure allows the first fluid to flow smoothly through the honeycomb structure 10 during the heat recovery mode (when the on-off valve 70 is closed), thereby reducing the pressure loss.

The ring-shaped member 80 is preferably made of a metal in terms of manufacturability, although not particularly limited thereto. Examples of the material of the ring-shaped member 80 that can be used herein include stainless steel, titanium alloys, copper alloys, aluminum alloys, brass and the like. Among them, the stainless steel is preferable because it has high durability and reliability and is inexpensive.

The ring-shaped member 80 preferably has a thickness of 0.1 mm or more, and more preferably 0.3 mm or more, and still more preferably 0.5 mm or more, although not particularly limited thereto. The thickness of the ring-shaped member 80 of 0.1 mm or more can ensure durability and reliability. The thickness of the ring-shaped member 80 is preferably 10 mm or less, and more preferably 5 mm or less, and still more preferably 3 mm or less. The thickness of the ring-shaped member 80 of 10 mm or less can reduce the weight of the heat exchanger 100.

The first fluid and the second fluid used in the heat exchanger 100 are not particularly limited, and various liquids and gases can be used. For example, when the heat exchanger 100 is mounted on a motor vehicle, an exhaust gas can be used as the first fluid, and water or engine antifreeze coolants (LLC defined by JIS K2234:2006) can be used as the second fluid. Further, the first fluid can be a fluid having a temperature higher than that of the second fluid.

The heat exchanger 100 can be produced in accordance with a method known in the art. For example, the heat exchanger 100 can be produced in accordance with the method as described below.

First, the honeycomb structure 10 is inserted into the first outer cylindrical member 20, and the first outer cylindrical member 20 is fitted to the outer peripheral wall 12 of the honeycomb structure 10. Subsequently, the first inner cylindrical member 30 is inserted into the hollow region of the honeycomb structure 10 and the first inner cylindrical member 30 is fitted to the inner peripheral wall 11 of the honeycomb structure 10. The second outer cylindrical member 60 is then arranged on and fixed to the radially outer side of the first outer cylindrical member 20. The feed pipe 62 and the discharge pipe may be previously fixed to the second outer cylindrical member 60, but they may be fixed to the second outer cylindrical member 60 at an appropriate stage. Next, the second inner cylindrical member 40 is arranged on the predetermined position, and fixed to the first outer cylindrical member 20. Further, when the ring-shaped member 80 is provided, the ring-shaped member 80 is arranged between the second inner cylindrical member 40 and the first outer cylindrical member 20 or the second outer cylindrical member 60 and fixed. The tubular member 50 is then placed on the outflow port 21*b* side of the first outer cylindrical member 20 and connected. The on-off valve 70 is then attached to the outflow port 31*b* side of the first inner cylindrical member 30.

In addition, the arranging and fixing (fitting) orders of the respective members are not limited to the above orders, and they may be changed as needed within a range in which the members can be produced. As the fixing (fitting) method, the above method may be used.

EXAMPLES

Hereinafter, the present invention will be described in more detail with reference to Examples, but the present invention is not limited to these Examples.

Examples 1 to 4 and Comparative Example 3

A binder and water or an organic solvent were added to SiC powder, and the resulting mixture was kneaded to form a green body, which was then formed into a predetermined shape to obtain a honeycomb formed body. Subsequently, the obtained honeycomb formed body was dried, and the inner peripheral wall was internally ground and the outer peripheral wall was cylindrically ground. The honeycomb formed body was then fired while impregnating it with metal Si to obtain a honeycomb structure. Table 1 shows details of the shapes of the obtained honeycomb structures. It should be noted that the average thickness and the number of the first partition walls and the second partition walls were adjusted by selecting a die and jig each having an appropriate shape. Further, the average thickness, the standard deviation of the thickness, and the inner diameter of the inner peripheral wall, and the average thickness, the standard deviation of the thickness, and the outer diameter of the outer peripheral wall were controlled by adjusting grinding conditions.

Each honeycomb structure obtained above was evaluated for the internal pressure strength and the external pressure strength.

The internal pressure strength was determined as follows: A test sample in which portions of the honeycomb structure other than the inner peripheral wall were protected with a jig, a sealant was placed on the inner peripheral wall, and the whole was sealed with a vacuum pack (a test sample in which only the inner peripheral wall was not protected by the jig) was prepared. The test sample was placed in a pressure vessel filled with water, and a pressure at which the pressure was increased to cause the sample to be broken was defined as the internal pressure strength. This test was conducted five times, and an average value thereof was determined to be evaluation results.

The external pressure strength was determined as follows: A test sample in which both end faces (including the hollow region) of the honeycomb structure were protected with a jig, a sealant was placed on the outer peripheral wall, and the whole was sealed with a vacuum pack (a test sample in which only the outer peripheral wall was not protected with the jig) was prepared. The test sample was placed in a pressure vessel filled with water, and a pressure at which the pressure was increased to cause the sample to be broken was defined as the external pressure strength. This test was conducted five times, and an average value thereof was determined to be evaluation results.

In the evaluation of the internal pressure strength or the external pressure strength, the test sample having an internal pressure strength of 20 MPa or more and an external pressure strength of 30 MPa or more is represented by A (the internal pressure strength and the external pressure strength are excellent), a test sample having an internal pressure strength of 9 MPa or more and less than 20 MPa, and an external pressure strength of 9 MPa or more and less than 30 MPa is represented by B (the internal pressure strength and the external pressure strength are at acceptable levels), and a test sample having an internal pressure strength or an external pressure strength of less than 9 MPa is represented by C (the internal pressure strength and the external pressure strength are poor).

The above evaluation results are shown in Table 1.

TABLE 1

| | Inner Peripheral Wall | | | Outer Peripheral Wall | | | First Partition Wall | | Second Partition Wall | | Internal | External |
|---|---|---|---|---|---|---|---|---|---|---|---|---|
| | Average Thickness [mm] | Thickness Variation Coefficient | Inner Diameter [mm] | Average Thickness [mm] | Thickness Variation Coefficient | Outer Diameter [mm] | Number | Average Thickness [mm] | Number | Average Thickness [mm] | Pressure Strength [MPa] | Pressure Strength [MPa] |
| Ex. 1 | 0.1 | 1.0 | 70 | 0.1 | 1.0 | 90 | 300 | 0.3 | 2 | 0.2 | A | A |
| Ex. 2 | 1.5 | 0.5 | 60 | 1.5 | 0.5 | 80 | 250 | 0.3 | 2 | 0.2 | A | A |
| Ex. 3 | 0.1 | 1.0 | 70 | 0.1 | 1.0 | 90 | 150 | 0.3 | 1 | 0.2 | B | B |
| Ex. 4 | 1.0 | 0.6 | 70 | 1.0 | 0.6 | 90 | 300 | 0.1 | 2 | 0.1 | B | B |
| Comp. 1 | 0.5 | 1.5 | 60 | 0.5 | 1.5 | 90 | 250 | 0.3 | 4 | 0.2 | A | C |
| Comp. 2 | 0.5 | 1.0 | 60 | 0.5 | 1.5 | 80 | 250 | 0.3 | 2 | 0.2 | A | C |
| Comp. 3 | 0.05 | 2.0 | 60 | 0.05 | 1.5 | 90 | 300 | 0.3 | 2 | 0.2 | C | C |

Comparative Example 1

A honeycomb structure was obtained by the same method as that of Example described above, with the exception that the inner peripheral wall was not ground.

Comparative Example 2

A honeycomb structure was obtained by the same method as that of Example described above, with the exception that the outer peripheral wall was not ground.

As shown in Table 1, the honeycomb structures according to Examples in which the average thickness of each of the inner peripheral wall and the outer peripheral wall was 0.1 mm or more and the thickness variation coefficient was 1.0 or less had the good internal pressure strength and the good external pressure strength.

On the other hand, the honeycomb structure according to Comparative Example 1 had the poor external pressure strength because the thickness variation coefficient of each of the inner peripheral wall and the outer peripheral wall was more than 1.0.

The honeycomb structure according to Comparative Example 2 had the poor external pressure strength because the thickness variation coefficient of the outer peripheral wall was more than 1.0.

The honeycomb structure according to Comparative Example 3 had both the poor internal pressure strength and the poor external pressure strength, because the average thickness of each of the inner peripheral wall and the outer peripheral wall was less than 0.1 mm, and the thickness variation coefficient of each of the inner peripheral wall and the outer peripheral wall was more than 1.0.

As can be seen from the above results, according to the present invention, it is possible to provide a honeycomb structure having improved internal pressure strength and external pressure strength, and a heat exchanger using the same.

DESCRIPTION OF REFERENCE NUMERALS

10 honeycomb structure
11 inner peripheral wall
12 outer peripheral wall
13*a* first end face
13*b* second end face
14 cell
15 partition wall
15*a* first partition wall
15*b* second partition wall
20 first outer cylindrical member
21*a* inflow port
21*b* outflow port
30 first inner cylindrical member
31*a* inflow port
31*b* outflow port
32 through hole
33 downstream end portion
40 second inner cylindrical member
41*a* inflow port
41*b* outflow port
50 tubular member
51*a* inflow port
51*b* outflow port
60 second outer cylindrical member
61*a* inflow port
61*b* outflow port
62 feed pipe
70 on-off valve
71 bearing
72 shaft
80 ring-shaped member
100 heat exchanger

The invention claimed is:

1. A honeycomb structure comprising: an inner peripheral wall; an outer peripheral wall; and partition walls disposed between the inner peripheral wall and the outer peripheral wall, the partition walls defining a plurality of cells each extending from a first end face to a second end face, wherein, in a cross section orthogonal to an extending direction of the cells, the partition walls comprise one or more first partition walls extending in a radial direction, and wherein the inner peripheral wall and the outer peripheral wall have an average thickness of 0.1 mm or more, the average thickness being defined as an average value of thicknesses measured in at least eight positions in the cross section orthogonal to the extending direction of the cells, and a thickness variation coefficient of 1.0 or less, the thickness variation coefficient being defined as a value obtained by dividing a standard deviation calculated based on the thicknesses measured at the at least eight positions by the average thickness, represented by the following equation (1):

the thickness variation coefficient=a standard deviation of the thicknesses of the inner peripheral wall and the outer peripheral wall/an average thickness of the inner peripheral wall and the outer peripheral wall (1).

2. The honeycomb structure according to claim 1, wherein the partition walls further comprise one or more second partition walls extending in a circumferential direction in the cross section orthogonal to the extending direction of the cells.

3. The honeycomb structure according to claim 1, wherein the inner peripheral wall has an inner diameter of 20 to 200 mm, and the outer peripheral wall has an outer diameter of 30 to 300 mm.

4. The honeycomb structure according to claim 1, wherein the number of the first partition walls is 50 to 1500.

5. The honeycomb structure according to claim 2, wherein the number of the second partition walls is 50 or less.

6. The honeycomb structure according to claim 1, wherein the first partition walls have an average thickness of 0.1 to 1 mm.

7. The honeycomb structure according to claim 2, wherein the second partition walls have an average thickness of 0.1 to 1 mm.

8. The honeycomb structure according to claim 1, wherein a length in the extending direction of the cells is 10 to 300 mm.

9. A heat exchanger comprising the honeycomb structure according to claim 1.

* * * * *